US005630250A

United States Patent [19]

Chou

[11] Patent Number: 5,630,250

[45] Date of Patent: May 20, 1997

[54] DRAWBAR DEVICE

[76] Inventor: Cheng-Tsan Chou, 27, Lane 280, Chung Zhen Road, Sa Lu, Taichung Shien, Taiwan

[21] Appl. No.: 637,321

[22] Filed: Apr. 9, 1996

[51] Int. Cl.[6] ..... B25G 1/04

[52] U.S. Cl. ..... 16/115; 190/115; 280/47.315

[58] Field of Search ..... 16/115; 190/115, 190/18 A, 18 R, 14, 15 R, 104; 280/47.315, 47.317, 655, 655.1

[56] References Cited

U.S. PATENT DOCUMENTS

| | | | |
|---|---|---|---|
| 5,322,334 | 6/1994 | Hammer | 16/115 |
| 5,355,980 | 10/1994 | Hsieh | 16/115 |
| 5,500,981 | 3/1996 | Ho | 16/115 |
| 5,560,458 | 10/1996 | Franklin et al. | 190/115 |

*Primary Examiner*—Chuck Y. Mah

*Attorney, Agent, or Firm*—Peterson, Wicks, Nemer & Kamrath, P.A.

[57] ABSTRACT

A drawbar device comprises a first sectional handle, a second sectional handle coupling with the first sectional handle, an upper seat disposed under the sectional handles, a push button disposed in the first and second sectional handles, a first and second control plates connecting two ends of the push button respectively, the upper ends of the first and second control rods connecting the first and second control plates respectively, the lower ends of the first and second control rods connecting a first and second positioning blocks respectively, the first and second positioning blocks inserted in a first and second drawbars respectively to engage with a first and second pinions therein, a first and second outer pipes encasing the first and second drawbars respectively, and a lower seat having two recess holes to receive the lower ends of the corresponding first and second outer pipes respectively.

1 Claim, 5 Drawing Sheets

DRAWBAR DEVICE

BACKGROUND OF THE INVENTION

The invention relates to a drawbar device of a trunk. More particularly, the invention relates to a drawbar device which can be extended and positioned at a predetermined position.

There are many types of drawbar devices. However, most drawbar devices have very complex structures. Therefore, the drawbar devices will become useless if one or more critical element is broken. Once the critical element is broken, the drawbar device may not be extended after retracted. Otherwise, the drawbar device may not be retracted after extended. Another type of a drawbar device is a multiple sectional drawbar device. The multiple sectional drawbar device can be extended or retracted to two or three predetermined positions. However, the multiple sectional drawbar device cannot be extended or retracted to any desired position except two or three predetermined positions.

SUMMARY OF THE INVENTION

An object of the present invention is to provide a drawbar device of a trunk which has a simplified structure to elongate the period of usage.

Another object of the present invention is to provide a drawbar device of a trunk which can be extended and positioned at any predetermined position.

Accordingly, a drawbar device comprises a first sectional handle, a second sectional handle coupling with the first sectional handle, an upper seat disposed under the sectional handles, a push button disposed in the first and second sectional handles, a first and second control plates connecting two ends of the push button respectively, the upper ends of the first and second control rods connecting the first and second control plates respectively, the lower ends of the first and second control rods connecting a first and second positioning blocks respectively, the first and second positioning blocks inserted in a first and second drawbars respectively to engage with a first and second pinions therein, a first and second outer pipes encasing the first and second drawbars respectively, and a lower seat having two recess holes to receive the lower ends of the corresponding first and second outer pipes respectively. The first sectional handle has a first rectangular recess formed on the upper middle portion of the first sectional handle and a first retaining plate disposed at the bottom of the first sectional handle transversely. A first and second positioning holes are formed on the first sectional handle. The second sectional handle has a second rectangular recess formed on the upper middle portion of the second sectional handle and a second retaining plate disposed at the bottom of the second sectional handle transversely. A third and fourth positioning holes are formed on the second sectional handle. The second sectional handle couples with the first sectional handle to form a grip. The upper seat is disposed under the grip. The first and second rectangular recesses receive a top portion of the push button. Two blind holes are formed at two opposite ends of the push button. Each of the first and second control plates connects a corresponding blind hole of the push button, respectively. The first control plate has a first through hole thereon, a first pin hole to receive an elongated pin, and a first protrusion to receive a first spring. The second control plate has a second through hole thereon, a second pin hole to receive an elongated pin, and a second protrusion to receive a second spring. The upper seat is disposed under the grip. A first and second square holes are formed at two lateral ends of the upper seat, respectively. Two upper ends of the first and second control rods connect the first and second control plates, respectively. Each of the first and second positioning blocks has a round hole to receive the corresponding lower end of the control rod, respectively. Each of the first and second positioning blocks has a lower lug to engage with the corresponding first and second pinions, respectively. The first and second positioning blocks are inserted in the first and second drawbars, respectively. Each of the first and second drawbars has a circular hole and a rectangular notch at the lower end of each of the first and second drawbars, respectively. Each rectangular notch receives the pinion. Each pinion has a center hole. A positioning pin passes through the circular hole and the center hole to fasten the pinion in the drawbar pivotally. A first rack and the first drawbar are inserted in the first outer pipe in parallel. A second rack and the second drawbar are inserted in the second outer pipe in parallel. Each rack has a plurality of positioning teeth to engage with pinion teeth of the pinion. The lower seat has two recess holes to receive the lower ends of the corresponding first and second outer pipes, respectively. The first control plate and the grip are fastened pivotally. The second control plate and the grip are fastened pivotally. The first spring is disposed between the first control plate and the grip. The second spring is disposed between the second control plate and the grip.

DETAILED DESCRIPTION OF THE INVENTION

Figure 1:
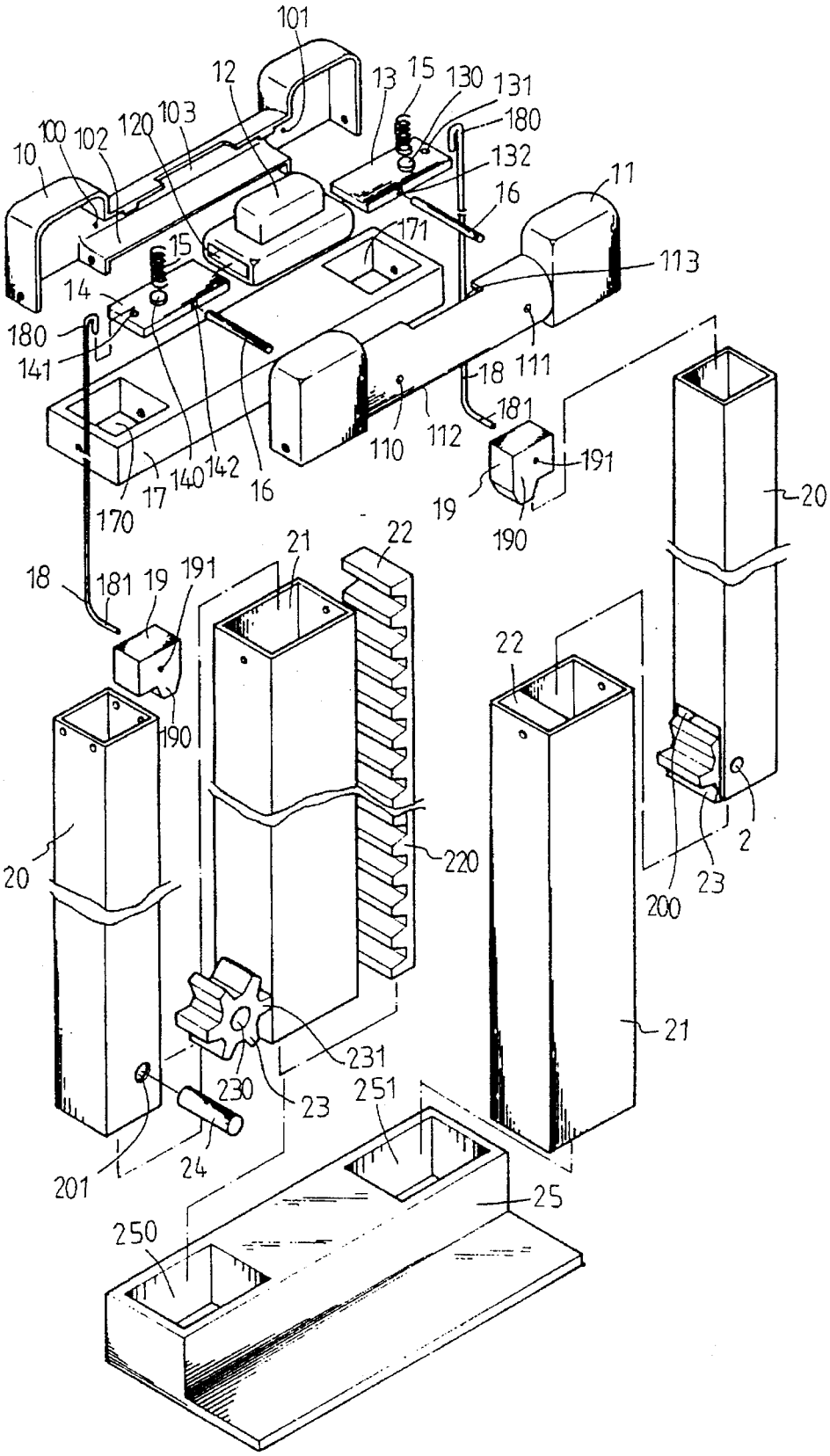
FIG. 1 is a perspective exploded view of a drawbar device of a preferred embodiment in accordance with the invention.

Referring to FIG. 1, a drawbar device comprises a first sectional handle 10, a second sectional handle 11 coupling with the first sectional handle 10, an upper seat 17 disposed under the sectional handles 10 and 11, a push button 12 disposed in the sectional handles 10 and 11, a first and second control plates 14 and 13 connecting two ends of the push button 12 respectively, the upper ends 180 of the first and second control rods 18 connecting the first and second control plates 14 respectively, the lower ends 181 of the first and second control rods 18 connecting a first and second positioning blocks 19 respectively, the first and second positioning blocks 19 inserted in a first and second drawbars 20 respectively to engage with a first and second pinions 23 therein, a first and second outer pipes 21 encasing the first and second drawbars 20 respectively, and a lower seat 25 having two recess holes 250 and 251 to receive the lower ends of the corresponding first and second outer pipes 21 respectively.

Figure 2:
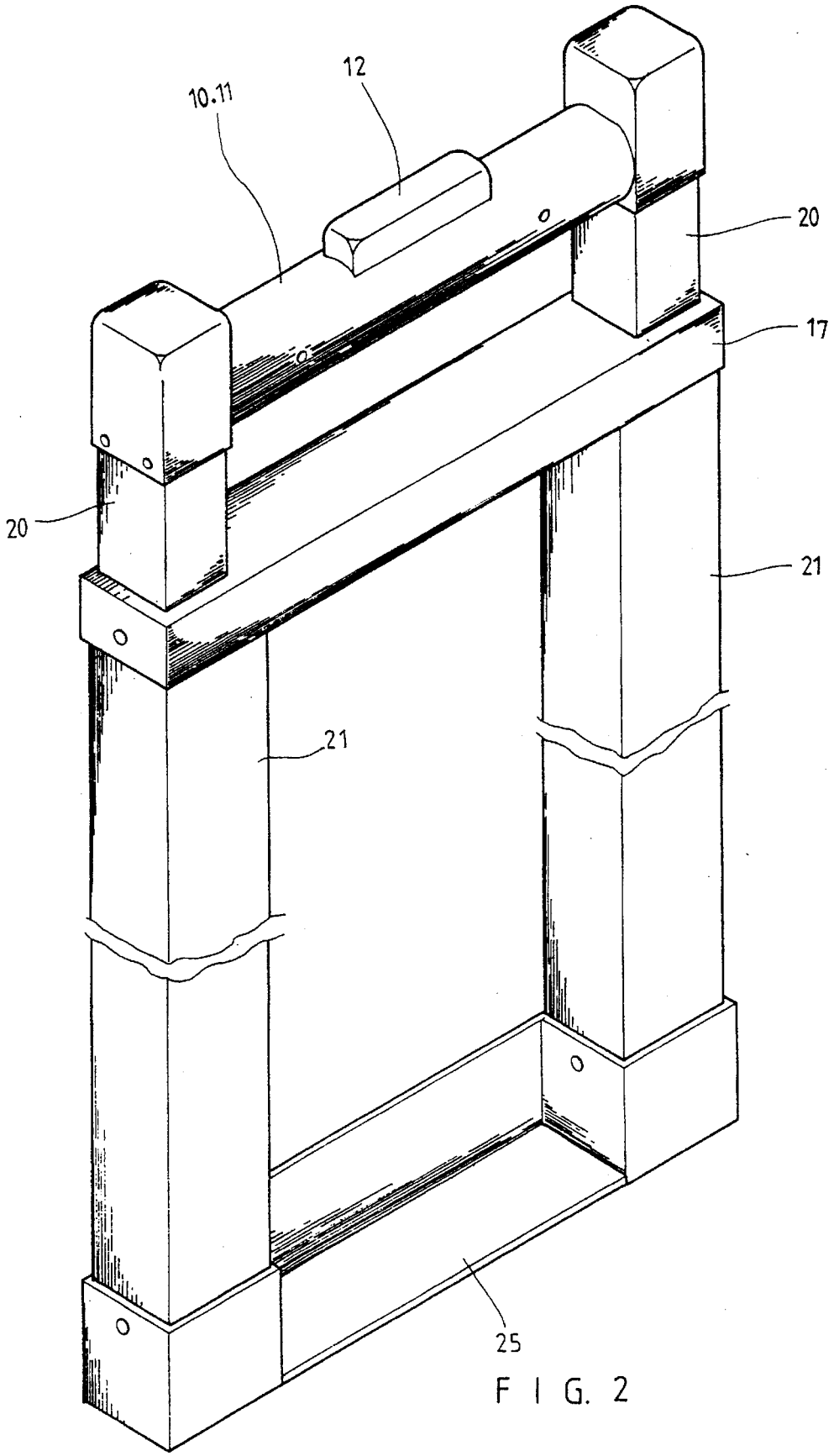
FIG. 2 is a perspective assembly view of FIG. 1.

Referring to FIGS. 1 and 2, the first sectional handle 10 has a first rectangular recess 103 formed on the upper middle portion of the first sectional handle 10 and a first retaining plate 102 disposed at the bottom of the first sectional handle 10 transversely. A first and second positioning holes 100 and 101 are formed on the first sectional handle 10. The second sectional handle 11 has a second rectangular recess 113 formed on the upper middle portion of the second sectional handle 11 and a second retaining plate 112 disposed at the bottom of the second sectional handle 11 transversely. A third and fourth positioning holes 110 and 111 are formed on the second sectional handle 11. The second sectional handle 11 couples with the first sectional handle 10 to form a grip. The upper seat 17 is disposed under the grip. The first and second rectangular recesses 103 and 113 receive a top portion of the push button 12. Two blind holes 120 are formed at two opposite ends of the push button 12. The first and second control plates 14 and 13 connect two corresponding blind holes 120 of the push button 12, respectively. The first control plate 14 has a first through hole 141 thereon, a first pin hole 142 to receive an elongated pin 16, and a first protrusion 140 to receive a first spring 15. The second control plate 13 has a second through hole 131 thereon, a second pin hole 132 to receive an elongated pin 16, and a second protrusion 130 to receive a second spring 15. The upper seat 17 is disposed under the grip. A first and second square holes 170 and 171 are formed at two lateral ends of the upper seat 17, respectively. Two upper ends 180 of the first and second control rods 18 connect the first and second control plates 14, respectively. Each of the first and second positioning blocks 19 has a round hole 191 to receive the corresponding lower end 181 of the control rod 18, respectively. Each of the first and second positioning blocks 19 has a lower lug 190 to engage with the corresponding first and second pinions 23, respectively. The first and second positioning blocks 19 are inserted in the first and second drawbars 20, respectively. Each of the first and second drawbars 20 has a circular hole 201 and a rectangular notch 200 at the lower end of each of the first and second drawbars 20, respectively. Each rectangular notch 200 receives the pinion 23. Each pinion 23 has a center hole 230. A positioning pin 24 passes through the circular hole 201 and the center hole 230 to fasten the pinion 23 in the drawbar 20 pivotally. A rack 22 and the drawbar 20 are inserted in an outer pipe 21 in parallel. The rack 22 has a plurality of positioning teeth 220 to engage with pinion teeth 231 of the pinion 23. The lower seat 25 has two recess holes 250 and 251 to receive the lower ends of the corresponding first and second outer pipes 21, respectively. The first elongated pin 16 passes through the corresponding holes 110, 142 and 100 to fasten the first control plate 14 and the grip pivotally. The second elongated pin 16 passes through the corresponding holes 111, 132 and 101 to fasten the second control plate 13 and the grip pivotally. The first spring 15 is disposed between the first control plate 14 and the grip. The second spring 15 is disposed between the second control plate 13 and the grip. Two ends of the grip connect two upper ends of the first and second drawbars 20, respectively.

Figure 3:
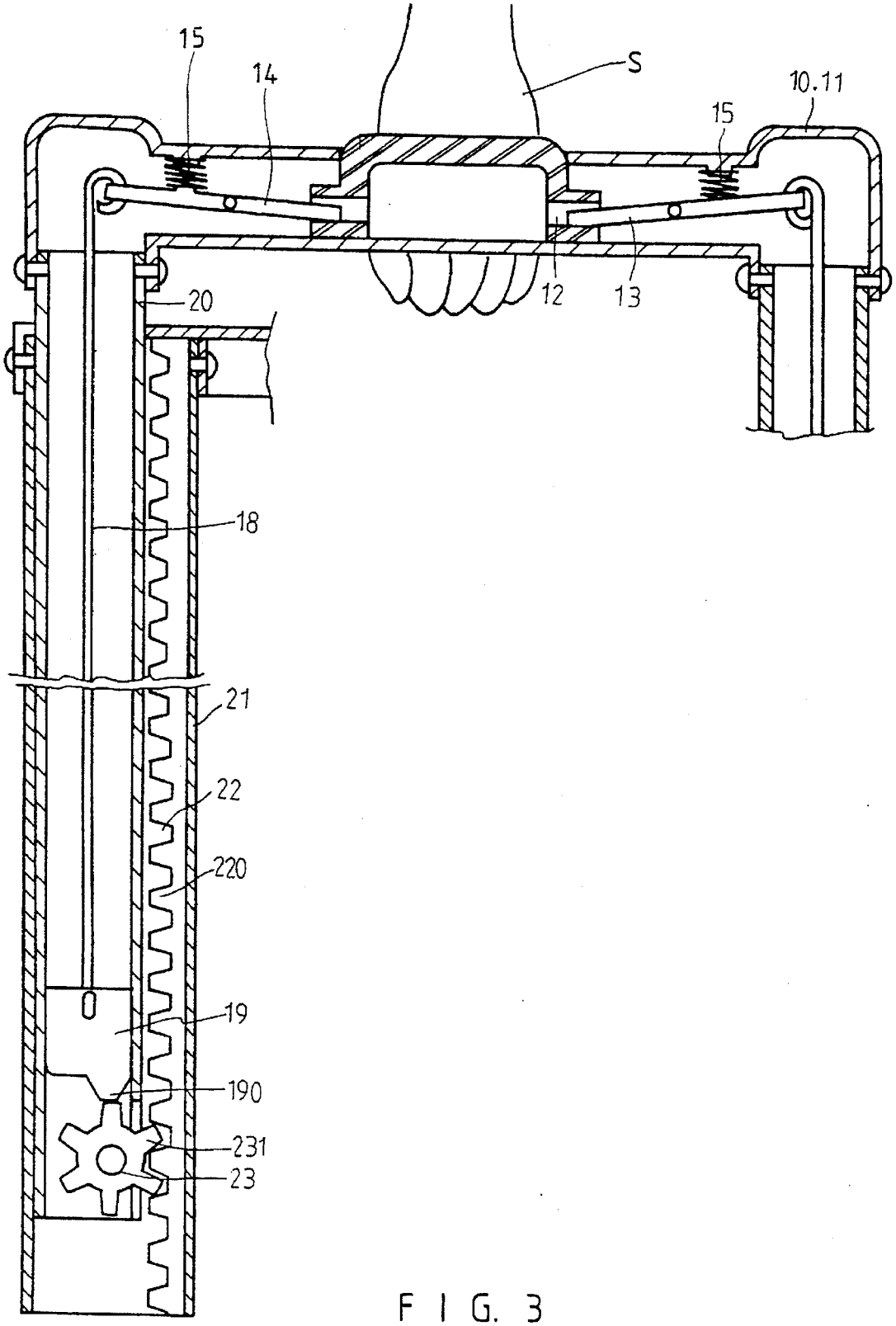
FIG. 3 is a schematic view illustrating the operation of extending or retracting a drawbar device.

Referring to FIG. 3, the hand S of the user holds the grip and pushes down the push button 12. The ends of the control plates 14 and 13 which abut the push button 12 are descended. The ends of the control plates 14 and 13 which connect the control rods 18 are ascended. The positioning blocks 19 will be ascended. The lug 190 will be disengaged with the pinion 23. The pinion 23 can be moved along the rack 22 freely.

Figure 4:
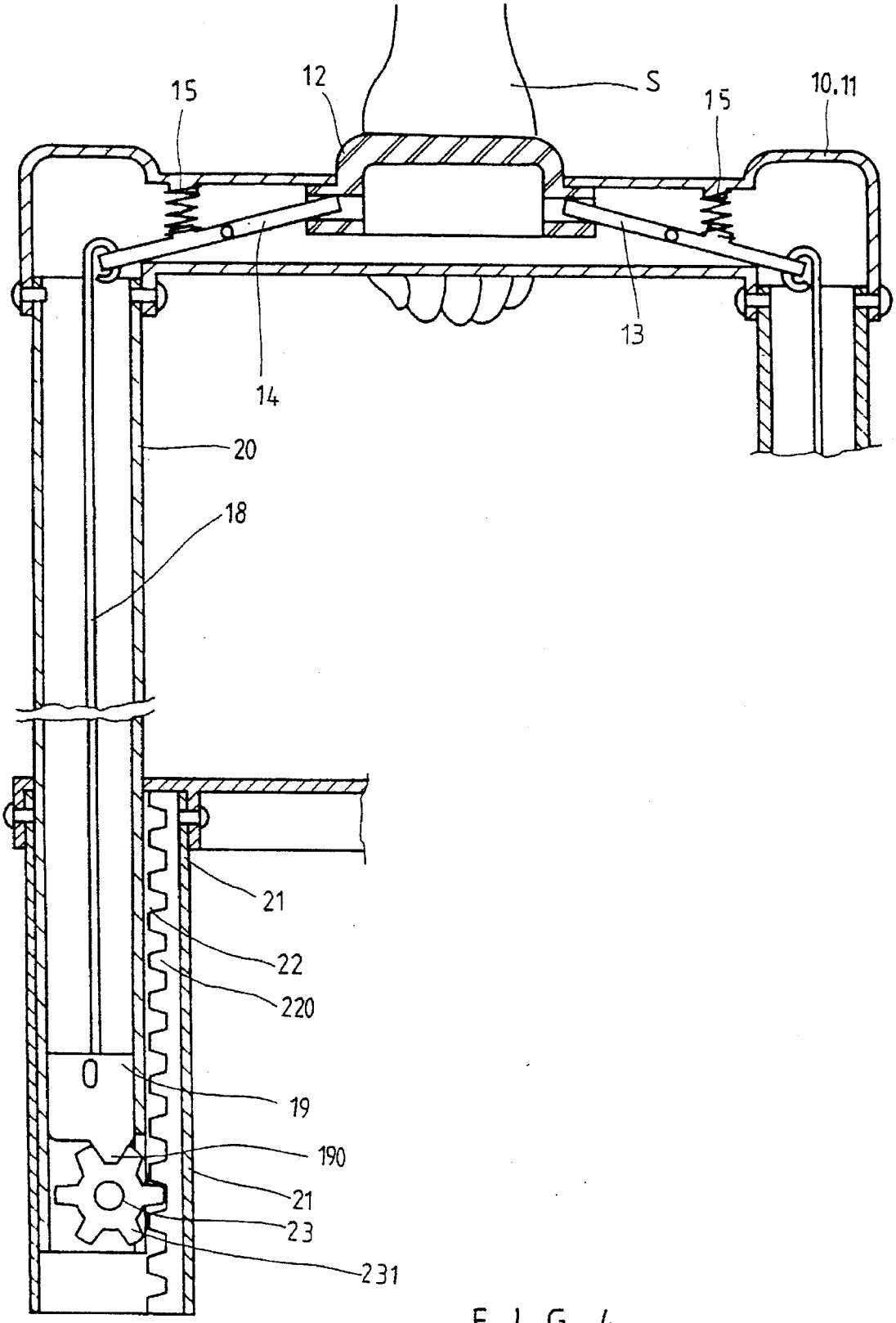
FIG. 4 is a schematic view illustrating the operation of positioning a drawbar device.

Referring to FIG. 4, the hand S of the user holds the grip and releases the push button 12. The springs 15 force the ends of the control plates 14 and 13 which connect the control rods 18 to descend. The positioning blocks 19 will be descended. The lug 190 will be engaged with the pinion 23 again. The pinion 23 cannot be moved along the rack 22 freely.

Figure 5:
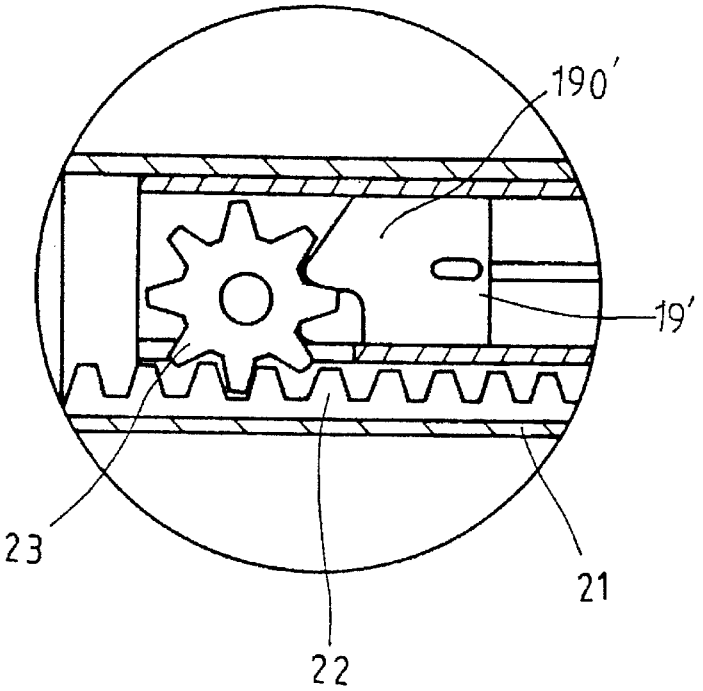
FIG. 5 is a schematic view illustrating a second positioning block engaging with a pinion.
Figure 6:
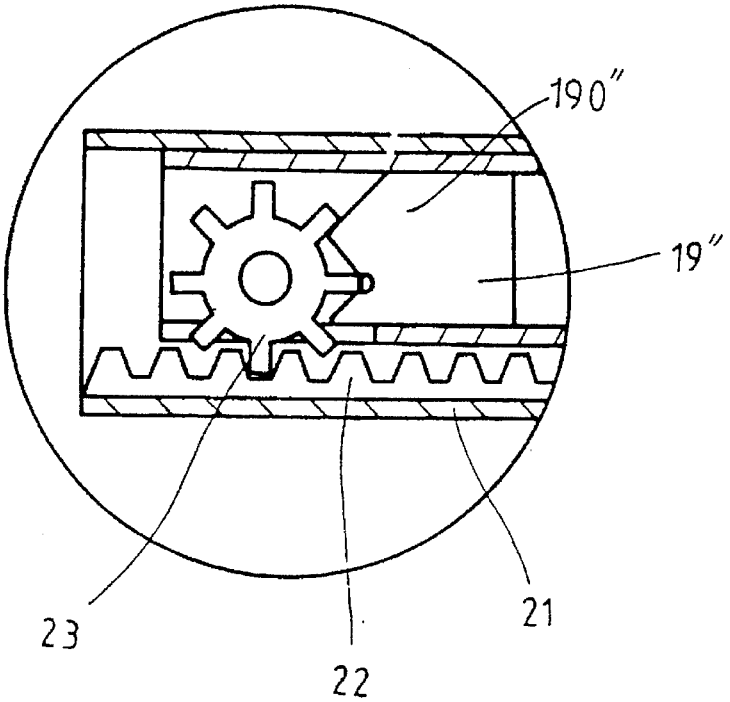
FIG. 6 is a schematic view illustrating a third positioning block engaging with a pinion.

FIG. 5 illustrates another positioning block 19' with a different shape of lug 190' engaging with the pinion 23. FIG. 6 illustrates a further positioning block 19" with a different shape of lug 190' engaging with the pinion 23.

The invention is not limited to the above embodiment but various modification thereof may be made. Further, various changes in form and detail may be made without departing from the scope of the invention.

I claim:

1. A drawbar device comprising:

a first sectional handle having a first rectangular recess formed on an upper middle portion of said first sectional handle and a first retaining plate disposed at a bottom of said first sectional handle transversely;

a first and second positioning holes formed on said first sectional handle;

a second sectional handle having a second rectangular recess formed on an upper middle portion of said second sectional handle and a second retaining plate disposed at a bottom of said second sectional handle transversely;

a third and fourth positioning holes formed on said second sectional handle;

said second sectional handle coupling with said first sectional handle to form a grip;

an upper seat disposed under said grip;

said first and second rectangular recesses receiving a top portion of a push button;

two blind holes formed at two opposite ends of said push button;

a first and second control plates connecting said corresponding blind holes, respectively;

said first control plate having a first through hole thereon, a first pin hole, and a first protrusion to receive a first spring;

said second control plate having a second through hole thereon, a second pin hole to receive an elongated pin, and a second protrusion to receive a second spring;

two ends of said grip connecting two upper ends of a first and second drawbars, respectively;

a first and second square holes formed at two lateral ends of said upper seat, respectively;

two upper ends of a first and second control rods connecting said first and second control plates, respectively;

each of a first and second positioning blocks having a round hole to receive a corresponding lower end of said control rod, respectively;

each of said first and second positioning blocks having a lower lug to engage with a corresponding first and second pinions, respectively;

said first and second positioning blocks inserted in said first and second drawbars, respectively;

each of said first and second drawbars having a circular hole and a rectangular notch at a lower end of each of said first and second drawbars, respectively;

each said rectangular notch receiving said pinion;

each said pinion having a center hole;

a positioning pin passing through said circular hole and said center hole to fasten said pinion in said drawbar pivotally;

a first rack and said first drawbar inserted in a first outer pipe in parallel;

a second rack and said second drawbar inserted in a second outer pipe in parallel;

each said rack having a plurality of positioning teeth to engage with pinion teeth of said pinion;

a lower seat having two recess holes to receive two lower ends of said corresponding first and second outer pipes, respectively;

said first control plate and said second control plate being pivotally fastened to said grip;

said first spring disposed between said first control plate and said grip; and said second spring disposed between said second control plate and said grip.

* * * * *